US010393033B1

(12) United States Patent
Rayl, Jr.

(10) Patent No.: US 10,393,033 B1
(45) Date of Patent: Aug. 27, 2019

(54) HYDRAULIC SYSTEM PURGING VIA POSITION SYNCHRONIZED SOLENOID PULSING

(71) Applicant: GM Global Technology Operations LLC, Detroit, MI (US)

(72) Inventor: Allen B. Rayl, Jr., Waterford, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 6 days.

(21) Appl. No.: 15/938,313

(22) Filed: Mar. 28, 2018

(51) Int. Cl.
*F01L 1/24* (2006.01)
*F02D 17/02* (2006.01)
*F01L 13/00* (2006.01)

(52) U.S. Cl.
CPC ..... *F02D 17/02* (2013.01); *F01L 1/24* (2013.01); *F01L 13/0005* (2013.01); *F01L 2001/2444* (2013.01); *F01L 2013/001* (2013.01); *F02D 2200/0404* (2013.01); *F02D 2200/101* (2013.01)

(58) Field of Classification Search
CPC ..... F01L 1/24; F01L 2001/2427; F01L 2001/2444; F01L 2001/256; F01L 13/0005; F01L 2013/001; F02D 13/06; F02D 17/02; F02D 2041/001; F02D 2200/023; F02D 2200/0404; F02D 2200/0406; F02D 2200/101
USPC ..... 123/90.12, 90.13, 90.55, 481, 198 F
See application file for complete search history.

(56) References Cited

U.S. PATENT DOCUMENTS

| | | | | |
|---|---|---|---|---|
| 6,557,518 | B1 * | 5/2003 | Albertson | F01L 13/0005 123/198 F |
| 6,584,942 | B1 * | 7/2003 | Albertson | F01L 1/14 123/90.12 |
| 2009/0150055 | A1 | 6/2009 | Kaiser et al. | |
| 2009/0205601 | A1 * | 8/2009 | Baker | F01L 1/053 123/90.57 |
| 2016/0281551 | A1 * | 9/2016 | Crowe | F01L 1/18 |

* cited by examiner

*Primary Examiner* — Jorge L Leon, Jr.

(57) ABSTRACT

A variable displacement internal combustion engine control system includes an engine having cylinders, each having an intake valve and an exhaust valve. An engine control module determines when to activate and deactivate the cylinders, and when to purge gas entrained in an oil system. A solenoid-actuated hydraulic control valve communicates with the engine control module to deactivate and activate individual cylinders. An air accumulation estimation program running multiple times per second for each of the cylinders identifies an approximate gas volume accumulating in a control port of the solenoid-actuated hydraulic control valve and if the gas volume has reached a predetermined threshold allows a purge pulse to be issued. The purge pulse initiates at a purge pulse initiation point during one of intake valve lift, exhaust valve lift, and when valve lifters of both the intake and the exhaust valve are on a base circle providing zero lift.

19 Claims, 3 Drawing Sheets

HYDRAULIC SYSTEM PURGING VIA POSITION SYNCHRONIZED SOLENOID PULSING

INTRODUCTION

The present disclosure relates to the control of internal combustion engines, including a method and apparatus to provide for the control of a variable displacement internal combustion engine.

Present regulatory conditions in the automotive market have led to an increasing demand to improve fuel economy and reduce emissions. Variable displacement internal combustion engines (ICEs) provide for improved fuel economy and torque on demand by operating on the principal of cylinder deactivation. During operating conditions that require high output torque, every cylinder of a variable displacement ICE is supplied with fuel and air (also spark, in the case of a gasoline ICE) to generate torque from the ICE. During operating conditions at low speed, low load and/or other inefficient conditions for a variable displacement ICE, certain ones of the cylinders may be selectively deactivated to improve fuel economy for the variable displacement ICE and vehicle. For example, in the operation of a vehicle equipped with an eight cylinder ICE, fuel economy will be improved if the ICE is operated with only four cylinders during low torque operating conditions by reducing throttling losses.

Throttling losses, also known as pumping losses, are the extra work that an ICE must perform to pump air around the restriction of a relatively closed throttle plate, and pump air from the relatively low pressure of an intake manifold through the ICE and out to the atmosphere. The cylinders that are deactivated will not allow air flow through their intake and exhaust valves, thereby reducing pumping losses by forcing the ICE to operate at a higher throttle plate angle and a higher intake manifold pressure. Since the deactivated cylinders do not allow air to flow, additional losses are avoided by operating the deactivated cylinders as "air springs" due to the compression and decompression of the air in each deactivated cylinder.

It is known in the art of engine cylinder deactivation to provide switchable hydraulic lash adjusters (SHLA) operable to either actuate the valves of a deactivation cylinder or to maintain the valves closed through lost motion features of the switchable hydraulic lash adjusters. Similar mechanisms may be provided in a hydraulic valve lifter (HVL) which includes internally a hydraulic lash adjusting mechanism and so may be referred to broadly as a switchable hydraulic lash adjuster (SHLA).

Conventional lash adjusters are supplied with pressurized oil through a lash adjuster gallery or lifter gallery to annular feed grooves or intake ports which provide oil pressure to take up the lash in the valve train between the valve and its associated tappet, pushrod or other actuator. SHLAs and switchable valve lifters with cylinder deactivation may have an additional port for a lock pin which connects through control passages and a control channel with a valved oil pressure supply. A three-way solenoid-actuated hydraulic control valve may be used to connect oil pressure to the lock pin for cylinder deactivation or switching of the SHLAs in a supply mode of the three-way valve and to exhaust oil pressure from the oil passages and control gallery in an exhaust mode.

The cylinder deactivation apparatus typically uses complex systems of bypass channels and hydraulic bleeds in order to purge air or other gas/vapor from the hydraulic system to ensure consistent and timely response to control signals. This is necessary to provide reliable actuation or deactivation of the switchable hydraulic lash adjusters in the apparatus when the hydraulic control valve is actuated to make a change in operation. Air which is trapped in cylinder deactivation hydraulic control passages causes unpredictable increases and variations in response times, limiting operating regions or causing mistimed deactivation events. Systems which deactivate different quantities of cylinders (e.g., more or less than half of available cylinders) create sequence issues with deactivation timing. Thus, a simplified system for purging gas/vapor, primarily air, from the hydraulic cylinder deactivation system is desired.

Thus, while current cylinder deactivation systems achieve their intended purpose, there is a need for a new and improved system and method for automobile vehicle cylinder deactivation.

SUMMARY

According to several aspects, a variable displacement internal combustion engine control system includes an engine including "N" cylinders, each of the cylinders having an intake valve and an exhaust valve. An engine control module controls operation of the engine including determining when to activate and deactivate one or more of the cylinders, and when to purge gas entrained in an oil system of the engine using a purge pulse. A solenoid-actuated hydraulic control valve is in communication with the engine control module, the solenoid actuated hydraulic control valve operated to deactivate and activate one of the cylinders. The purge pulse is limited to a purge pulse range between approximately 390 to 600 degrees of a running crank angle of the engine.

In another aspect of the present disclosure, upon engine startup, the engine control module enables the solenoid-actuated hydraulic control valve to initiate individual purge pulses defining multiple purge cycles, cylinder deactivation being precluded during the purge cycles.

In another aspect of the present disclosure, an exhaust port of the solenoid-actuated hydraulic control valve wherein the gas entrained in the oil system is exhausted through the exhaust port.

In another aspect of the present disclosure, the purge pulse is initiated at a purge pulse initiation point occurring after initiation of lift of the intake valve.

In another aspect of the present disclosure, the purge pulse ends at a purge pulse end point when the lift of the intake valve returns to zero.

In another aspect of the present disclosure, the hydraulic control valve includes a locking pin exposed to pressurized oil to disconnect the locking pin thereby deactivating one of the cylinders.

In another aspect of the present disclosure, cylinder deactivation is accomplished by opening the solenoid-actuated hydraulic control valve to feed the pressurized oil through the control passages to disconnect the locking pin, and when conditions calling for cylinder activated operation are present, the solenoid-actuated hydraulic control valve is actuated to an exhaust position, causing the locking pin to seat.

In another aspect of the present disclosure, the solenoid-actuated hydraulic control valve is directly mounted to an engine block of the engine, with control passages for the solenoid-actuated hydraulic control valve being positioned in the engine block.

In another aspect of the present disclosure, the solenoid-actuated hydraulic control valve includes a control port alternately connected with a supply port and an exhaust port, the supply port connected with an engine main oil supply which also feeds multiple pressure oil supply passages, the exhaust port returning oil to an engine oil system.

In another aspect of the present disclosure, an engine speed sensor generates a speed signal based on an engine speed; an intake manifold absolute pressure sensor generates a pressure signal based on a pressure of an intake manifold; and a throttle position sensor generates a position signal based on a throttle position; wherein the speed signal, the pressure signal and the position signal are forwarded to the engine control module.

According to several aspects, a variable displacement internal combustion engine control system includes an engine including "N" cylinders, each of the cylinders having an intake valve and an exhaust valve. An engine control module controls operation of the engine including determining when to activate and deactivate one or more of the cylinders, and when to purge gas entrained in an oil system of the engine. A solenoid-actuated hydraulic control valve is in communication with the engine control module. The solenoid actuated hydraulic control valve is operated to deactivate and activate the one or more of the cylinders. An air accumulation estimation program running multiple times per second for each of the cylinders identifying an approximate gas volume accumulating in a control port of the solenoid-actuated hydraulic control valve and if the gas volume has reached a predetermined threshold allowing a purge pulse to be issued. The purge pulse is initiated by the engine control module at a purge pulse initiation point occurring after initiation of lift of the intake valve, the purge pulse limited to a purge pulse range between approximately 390 to 600 degrees of a running crank angle of the engine.

In another aspect of the present disclosure, a purge enable program providing a set of global enables that must all be met before the purge pulse is enabled.

In another aspect of the present disclosure, the global enables include: a first confirmation step that determines if a predetermined engine startup delay period has been completed to allow the engine to stabilize; and a second confirmation step that identifies if an engine speed is within a predetermined range of engine speeds wherein the purge pulse can be sent.

In another aspect of the present disclosure, the global enables include: a third confirmation step that confirms if cylinder deactivation, if active, has stabilized; and a fourth confirmation step that confirms following an extended operating period at high engine speed if a predetermined minimum period for oil stabilization to occur has been met.

In another aspect of the present disclosure, the global enables include: a fifth confirmation step that confirms that the oil system pressure is within predetermined limits to permit the purge pulse; and a sixth confirmation step that confirms that an oil system temperature is within predetermined limits to permit the purge pulse.

In another aspect of the present disclosure, a purge delivery program determines when the purge pulse should be delivered for each cylinder. The purge delivery program: in a first confirmation step reading a value of a purge counter from a memory of the air accumulation estimation program to identify if the value of the purge counter is greater than or equal to one (1); in a second confirmation step determining from the memory if a purge enabled flag is present, and if the purge enabled flag is present enabling the purge pulse.

In another aspect of the present disclosure, the purge pulse ends at a purge pulse end point when the lift of the intake valve returns to zero, at a crank angle corresponding to intake or exhaust valve lift, or when on a base circle defining no valve lift.

According to several aspects, a variable displacement internal combustion engine control system includes an engine including "N" cylinders, each of the cylinders having an intake valve and an exhaust valve. An engine control module controls operation of the engine including determining when to activate and deactivate one or more of the cylinders, and when to purge gas entrained in an oil system of the engine. A solenoid-actuated hydraulic control valve is in communication with the engine control module. The solenoid actuated hydraulic control valve is operated to deactivate and activate the one or more of the cylinders. A purge enable program provides a set of global enables that must all be met before the purge pulse is enabled. The purge pulse is initiated by the engine control module at a purge pulse initiation point occurring after the purge pulse is enabled and after initiation of lift of the intake valve. The purge pulse is limited to a purge pulse range between approximately 390 to 600 degrees of a running crank angle of the engine.

In another aspect of the present disclosure, an air accumulation estimation program running multiple times per second together for each of the cylinders.

In another aspect of the present disclosure, the air accumulation estimation program identifies an approximate gas volume accumulating in a control port of the solenoid-actuated hydraulic control valve and if the gas volume has reached a predetermined threshold allowing the purge pulse request to be issued.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
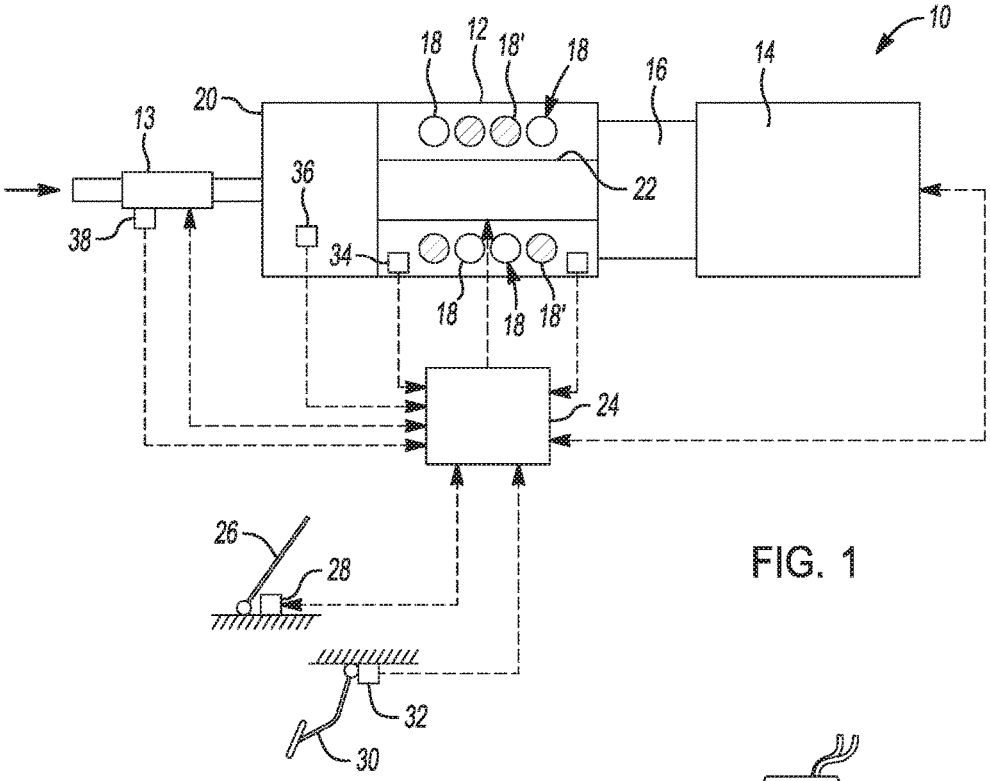
FIG. 1 is a diagrammatic presentation of a variable displacement internal combustion engine control system of the present disclosure.

The following description is merely exemplary in nature and is not intended to limit the present disclosure, application, or uses.

The following description is merely exemplary in nature and is not intended to limit the present disclosure, application, or uses. For purposes of clarity, the same reference numbers will be used in the drawings to identify the same elements. As used herein, activated refers to operation of an individual one of the engine cylinders, e.g., cylinder one. Deactivated refers to that cylinder (e.g., cylinder one) being inactive. As used herein, the term module and/or device refers to an application specific integrated circuit (ASIC), an electronic circuit, a processor (shared, dedicated, or group) and memory that execute one or more software or firmware programs, a combinational logic circuit, or other suitable components that provide the described functionality.

Referring to FIG. 1, a vehicle 10 includes an engine 12 that drives a transmission 14. The transmission 14 can include, but is not limited to, a manual transmission, an automatic transmission, a continuously variable transmission (CVT) and an automated manual transmission (AMT). The transmission 14 is driven by the engine 12 through a corresponding torque converter or clutch 16. The engine 12 is electronically controlled by an engine control module 24.

Air flows into the engine 12 through a throttle 13. The engine 12 includes "N" cylinders 18. One or more select cylinders 18' may be selectively deactivated during engine operation. Although FIG. 1 depicts eight cylinders (N=8), the engine 12 may include additional or fewer cylinders 18. For example, engines having 4, 5, 6, 8, 10, 12 and 16 cylinders are contemplated. Air flows into the engine 12 through an intake manifold 20 and is combusted with fuel in the cylinders 18. The engine 12 may include a lifter oil manifold assembly (LOMA) 22 that deactivates selected ones of the cylinders 18', as described in further detail below in reference to FIG. 2, may include hydraulic control valves directly mounted to an engine block to control activation and deactivation of one or more of the cylinders 18 as described in greater detail in reference to FIG. 3 below, or have hydraulic control valves mounted in other locations on the engine 12 to control activation and deactivation of one or more of the cylinders 18.

The engine control module 24 communicates with the engine 12 and various inputs and sensors as discussed herein. A vehicle operator manipulates an accelerator pedal 26 to regulate the throttle 13. More particularly, a pedal position sensor 28 generates a pedal position signal that is communicated to the control module 24. The control module 24 generates a throttle control signal based on the pedal position signal. A throttle actuator (not shown) adjusts the throttle 13 based on the throttle control signal to regulate air flow into the engine 12.

The vehicle operator manipulates a brake pedal 30 to regulate vehicle braking. More particularly, a brake position sensor 32 generates a brake pedal position signal that is communicated to the engine control module 24. The engine control module 24 generates a brake control signal based on the brake pedal position signal. A brake system (not shown) adjusts vehicle braking based on the brake control signal to regulate vehicle speed.

An engine speed sensor 34 generates a speed signal based on an engine speed. A mass air flow (MAF) sensor 36 generates a signal based on air flow through the intake manifold 20. A throttle position sensor (TPS) 38 generates a position signal based on a position of the throttle 13. These signals are forwarded to the engine control module 24 for processing.

An engine load may be determined based on the mass air flow (MAF), a cylinder mode and an engine speed. More particularly, if the MAF is below a load threshold for a given engine revolutions per minute (RPM), the engine load may be deemed light and the engine 12 may be transitioned to a deactivated mode wherein any one of more of the cylinders 18' are deactivated. If a desired torque is above a load threshold for the given RPM, the engine load may be deemed heavy and the engine 12 is operated in the fully activated mode with all cylinders 18, 18' active. The engine control module 24 controls components such as hydraulic control valves to regulate between the deactivated and the activated modes as discussed in further detail below in reference to FIGS. 2 and 3.

During operation at low engine load, the engine control module 24 may transition the engine 12 to the deactivated mode. In an exemplary embodiment, N/2 cylinders 18' (i.e. 4 or half of the cylinders N of the exemplary 8 cylinder engine) are deactivated, although any number of cylinders may be deactivated. Upon deactivation of the selected cylinders 18', the engine control module 24 may increase the power output of the remaining or activated cylinders 18. Inlet and exhaust valves of the deactivated cylinders 18' are closed to reduce pumping losses.

Figure 2:
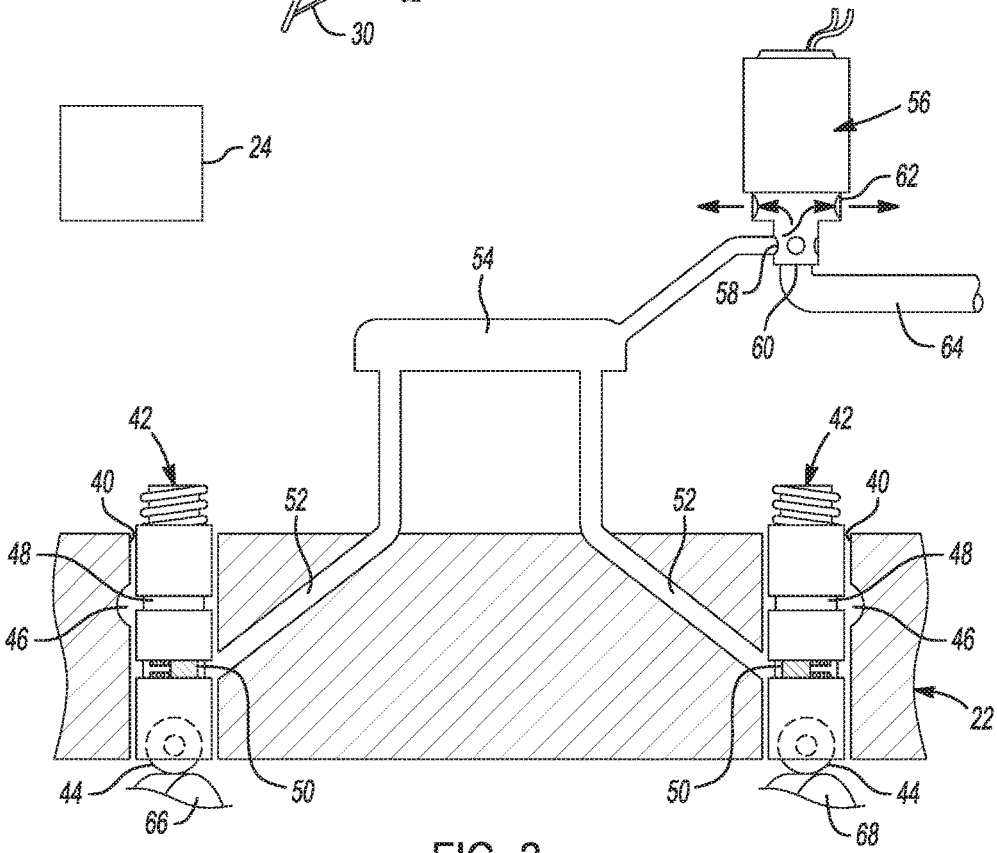
FIG. 2 is a partial cross sectional elevational view of a lifter oil manifold assembly connected to a solenoid-actuated hydraulic control valve.

Referring to FIG. 2, according to further aspects, the LOMA 22 includes a plurality of through bores 40 containing hydraulic valve lifters 42. The valve lifters 42 may include roller followers 44 that are engaged by a camshaft, not shown, for actuating the lifters 42 in timed relation to an engine speed. Each valve lifter 42 forms part of a valve train, not shown, which is connected to operate one of multiple valves of an engine cylinder that it is desired to deactivate by holding the valves closed during certain engine operating conditions. The valve lifters 42 are of a known deactivating or switching type which is actuated by an oil pressure signal to cause the valve lifter 42 to telescope and allow its valve to remain closed while the engine is running. Upon removal of the oil pressure signal, the valve and the cylinder are again operated in a conventional manner.

The LOMA 22 includes a pressure oil supply passage or main gallery 46, a portion of which communicates with annular feed grooves 48 that feed pressurized oil to lash adjusters of the valve lifters 42. Each of the valve lifters 42 also has a locking pin 50 carried in a pin bore. The locking pin 50 is exposed to control passages 52 extending in the LOMA 22 to a control channel 54 which may be internal or external to the LOMA 22. The control channel 54 communicates with a solenoid-actuated hydraulic control valve 56 defining one of multiple solenoid-actuated hydraulic control valves each having a control port 58 alternately connectable with a supply port 60 and an exhaust port 62. The supply port 60 is connected with an engine main oil supply 64 which also feeds the pressure oil supply. The exhaust port 62 returns discharged oil to the engine oil system. The engine main oil supply 64 only connects to the control channel 54 through the solenoid-actuated hydraulic control valve 56.

In operation, the solenoid-actuated hydraulic control valve 56 is de-energized when the engine is inoperative. The de-energized solenoid-actuated hydraulic control valve 56 remains in an exhaust position, draining pressurized oil from the control channel 54 and the locking pins 50 of the associated valve lifters 42 so that the valve lifters 42 are placed in their normal operating positions. Upon starting the engine, pressure is developed in the engine main oil supply 64 and the engine initially operates normally on all cylinders without cylinder deactivation. To purge any air that may be trapped in the area of the solenoid-actuated hydraulic control valve 56 upon engine startup, the engine control module 24 enables the solenoid-actuated hydraulic control valve 56 to conduct approximately 10 to 15 purge cycles to drive air in the system out through the exhaust port 62 of the solenoid-actuated hydraulic control valve 56. Cylinder deactivation is precluded during this initial 10 to 15 purge cycles, and further until engine conditions permit cylinder deactivation. It is noted the 10 to 15 purge cycles is an approximate value, and the actual number of purge cycles can vary above and below the 10 to 15 purge cycles identified herein.

After a predetermined time interval, and when the system achieves deactivation status, when one or more of the valves can be deactivated, the engine control module 24 enables the solenoid-actuated hydraulic control valve 56 to deactivate selected ones of the engine cylinders. This is done only when engine operating conditions call for engine operation on less than all the engine cylinders, such conditions including but not limited to an engine speed being in a predetermined range, a predetermined power range, a predetermined oil temperature and a predetermined oil pressure. Cylinder deactivation is accomplished by opening the solenoid-actuated hydraulic control valve 56 to feed pressurized oil through the control channel 54 and passages 52 to disconnect the locking pins 50 of the valve lifters 42 and allow the valve lifters 42 to telescope within themselves. During deactivation, the intake and exhaust valves connected with the deactivated valve lifters 42 remain closed and the valve lifter roller followers 44 oscillate freely without moving the valves from their seats. When conditions calling for activated or all-cylinder operation are present, the solenoid-actuated hydraulic control valve 56 is actuated to an exhaust position, removing pressure from the control passages 52 and the control channel 54, thereby allowing the locking pins 50 to reseat. Thereafter, the valve lifters 42 again actuate the valves in their opening and closing motions as driven by associated cams lobes 66, 68 of the camshaft.

Purging of entrained air and other vapors and gases from the control channel 54 occurs during initial start-up of the engine as noted above. When the valve lifters 42 are in the deactivation position, the control channel 54 is pressurized with the same oil feed pressure as the main oil supply 64. During normal operation with all cylinders, and for all active cylinders during cylinder activation operation, the oil passes through the control channel 54 and carries with it air or gas-entrained oil which may be trapped at or near the solenoid-actuated hydraulic control valve 56, which therefore must be periodically purged from the system and carried out through the exhaust port 62 of the solenoid-actuated hydraulic control valve 56. Purging operations are conducted to ensure a next desired cylinder deactivation event is not delayed due to compression of the air or gas-entrained oil delaying an oil pressure change when trapped air acts like an accumulator.

Referring to FIG. 3 and again to FIGS. 1 through 2, according to another aspect, an engine 70 includes multiple hydraulic control valves 72 (only one is shown for clarity) which are directly mounted to an engine block 74. Control passages 76, 78 for the hydraulic control valve 72 are connected to first and second lifter bores 80, 82. During normal operation with all cylinders, and for all active cylinders during cylinder activation operation, the oil passes through the control passages 76, 78, similar to flow through the control channel 54. When conditions calling for activated or all-cylinder operation are present, the solenoid-actuated hydraulic control valve 72 is actuated to an exhaust position, removing pressure from the control passages 76, 78. As previously noted herein, purging operations are conducted to ensure a next desired cylinder deactivation event is not delayed due to compression of the air or gas-entrained oil delaying an oil pressure change when trapped air acts like an accumulator in the control passages 76, 78.

Figure 3:
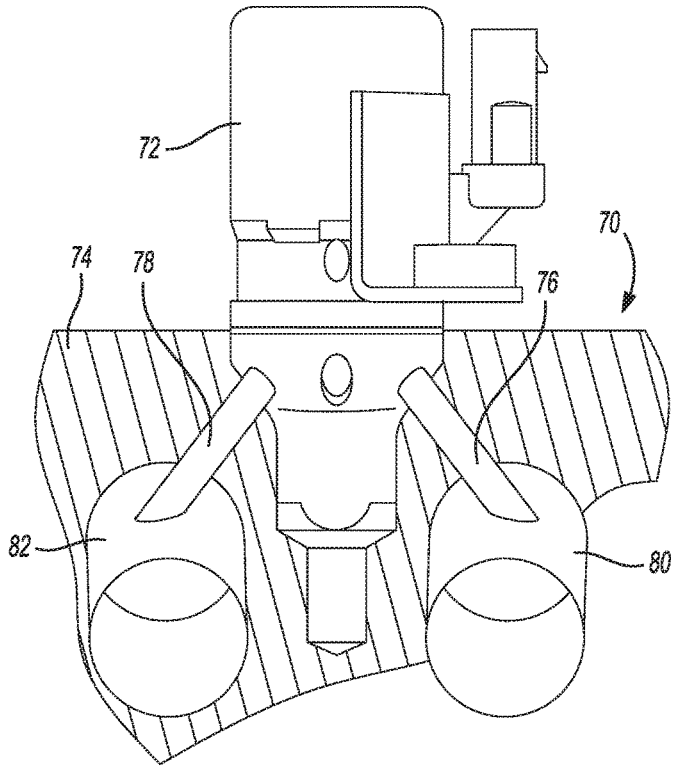
FIG. 3 is a partial cross sectional elevational view of another aspect having a solenoid-actuated hydraulic control valve mounted directly on an engine block.

Referring to FIG. 4 and again to FIGS. 1 through 3, a graph 92 presents a range of intake and exhaust valve lift values 94 compared to a running range of engine crank angles 96. An activated exhaust valve lift curve 98 precedes an activated intake valve lift curve 100 over the running crank angle. A trigger event curve 102 is also shown superimposed onto the exhaust and intake valve lift curves 98, 100 identifying decision points for initiation and cessation of cylinder deactivation and cylinder purge events. A system hydraulic pressure curve 104 is also superimposed, which identifies an exemplary purge pulse 106 which is initiated at a purge pulse initiation point 108 occurring after initiation of intake valve lift at an initiation point 110 of the activated intake valve lift curve 100. A peak hydraulic pressure 112 of the purge pulse 106 is substantially equal to the hydraulic system operating pressure, which can vary with engine operating conditions such as power, temperature and speed.

According to several aspects, the purge pulse 106 is limited to a purge pulse range 114 between approximately 390 to 600 degrees of the running crank angle 96 (a range of approximately 210 degrees) and ends at a purge pulse end point 116, where the hydraulic pressure returns to zero. This purge pulse range 114 is limited to ensure the purge pulse 106 begins after initiation of intake valve lift and ends as the intake valve lift returns to zero and before a deactivation decision point 118 is reached in the trigger event curve 102. The short purge pulse range 114 of approximately 210 degrees (provided within the running crank angle of 390 to 600 degrees) also minimizes any gas present in the oil system that impacts operation of the solenoid-actuated hydraulic control valve 56.

It is noted the above purge pulse range 114 ranging between approximately 390 to 600 degrees of the running crank angle 96 is used in when the cam phaser is in a park position, but will change when the cam is phased and could change for other applications. For example, the purge pulse can be used at three places or times, during intake lift as described above, during exhaust lift, and when both valve lifters are on a base circle. The primary consideration when selecting the timing of a purge pulse is to avoid an unintentional deactivation of a valve lifter.

Figure 4:
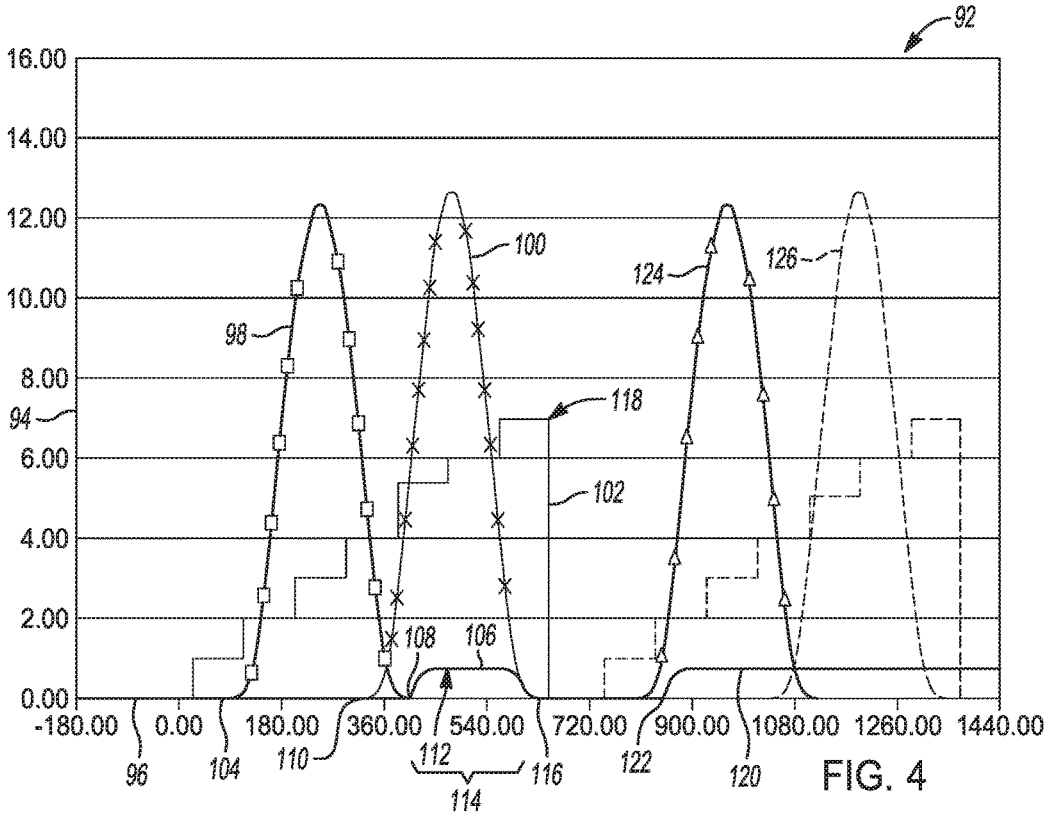
FIG. 4 is a graph presenting a range of intake and exhaust valve lift values compared to a running range of engine crank angles.

FIG. 4 further shows an exemplary decision to deactivate the cylinder, which occurs after cessation of the purge pulse 106. The engine control module 24 enables the solenoid-actuated hydraulic control valve 56 to deactivate selected ones of the engine cylinders by increasing oil pressure sending a deactivation pressure 120 which is initiated at a deactivation point 122. The deactivation point 122 follows initiation of a subsequent exhaust valve lift or deactivated exhaust valve lift curve 124 and occurs prior to initiation of a next intake valve lift, indicated in phantom as a phantom intake valve lift curve 126. It is noted FIG. 4 provides an exemplary condition related to intake valve lift, and does not exclude use of purge pulses synchronized to other crank angles.

Referring to FIG. 5 and again to FIGS. 1 and 2, a purge enable program 128 provides a set of global enables 130 that must all be met before a purge event is enabled. The global enables include a first confirmation step 132 that determines if a predetermined engine startup delay period has been completed to allow the system to stabilize. A second confirmation step 134 identifies if the engine speed is within a predetermined range of engine speeds wherein a purge pulse can be sent. A third confirmation step 136 confirms if cylinder deactivation, if active, has stabilized. A fourth confirmation step 138 confirms following an extended operating period at high engine speed if a predetermined minimum period for oil stabilization to occur has been met. For example, during operation at high engine speed increased levels of oil aeration are anticipated, which decrease over a period of approximately 30 seconds after cessation of high speed operation. A fifth confirmation step 140 confirms that the oil system pressure is within predetermined limits to permit a purge pulse. A sixth confirmation step 142 confirms that the oil system temperature is within predetermined limits to permit a purge pulse. If the response to all of the first, second, third, fourth, fifth and sixth confirmation steps is positive, in a memory 144 a purge enabled flag or purge request is saved and the global enables program ends at a step 146. If the response to any one or more of the first, second, third, fourth, fifth and sixth confirmation steps is negative, in a memory 148 a purge disabled flag is saved and the global enables program ends at the step 146. The purge enable program 130 repeats at a constant interval during engine operation.

Figure 5:
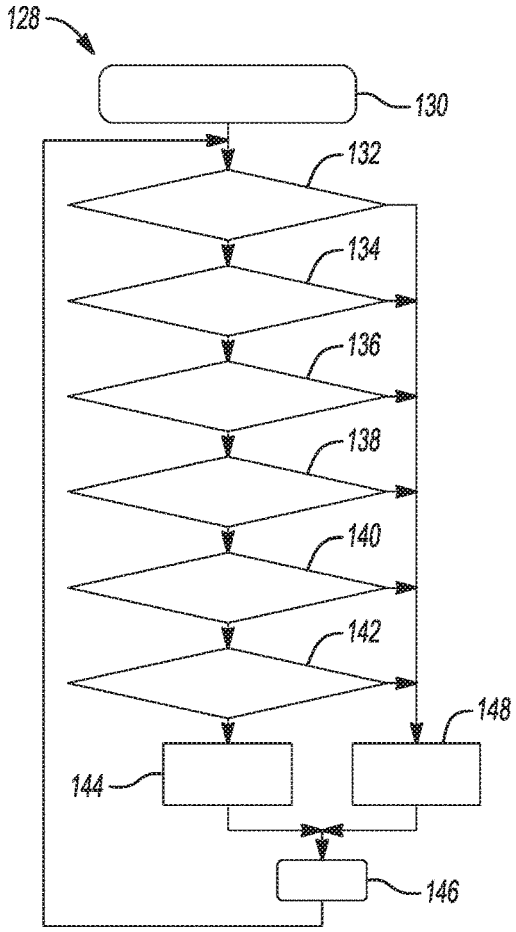
FIG. 5 is a flow chart depicting steps of a purge enable program providing a set of global enables that must all be met before a purge event is enabled.
Figure 6:
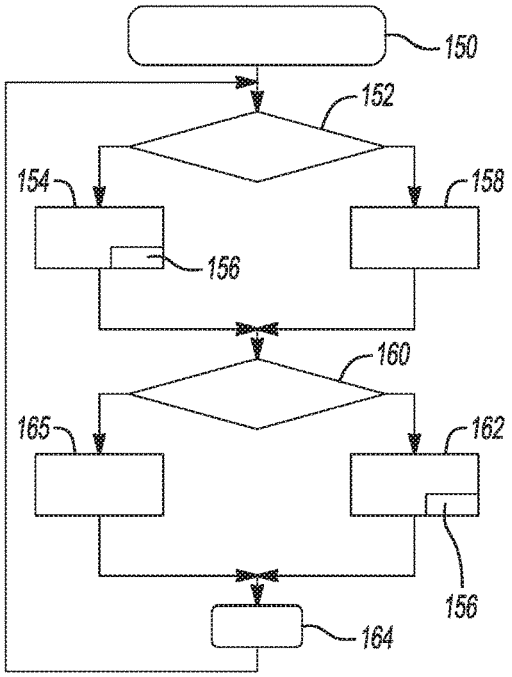
FIG. 6 is a flow chart depicting steps of an air accumulation estimation program.

Referring to FIG. 6 and again to FIGS. 1, 2 and 5, an air accumulation estimation program 150 also runs multiple times per second together with the purge enable program 130 for each cylinder. The air accumulation estimation program 150 identifies if and how much air is likely to be accumulating in the control port of the solenoid-actuated hydraulic control valve 56 and if the air volume has reached a predetermined threshold requiring a purge pulse to be issued. Following a program start, a first confirmation step 152 determines if an identified one of the cylinders is deactivated. If a response to the first confirmation step 152 is positive, it is assumed that oil system air is automatically purged and in a resetting step 154 an accumulated air volume is set to zero and a purge counter 156 also resets to zero. If a response to the first confirmation step 152 is negative indicating the cylinder is activated and air in the oil system may be accumulating, in an accumulation step 158 a new accumulated air volume is calculated by modifying a previous estimate of air volume by entering a table which modifies accumulated air volume to account for engine rpm, engine oil temperature and engine oil pressure.

In a second confirmation step 160 it is determined if the accumulated air volume is greater than a predetermined threshold. Because the result from the resetting step 154 is a zeroed accumulated air volume, only the new accumulated air volume from the accumulation step 158 can exceed the predetermined threshold. If the result from the second confirmation step 160 is yes, a purge request is saved in a memory 162, the purge counter 156 increases the purge request or count by one, and the air accumulation estimation program 150 ends at a step 164. If the result from the second confirmation step 160 is no, a purge request is flagged as disabled in a memory 165 and the program ends at the step 164.

Figure 7:
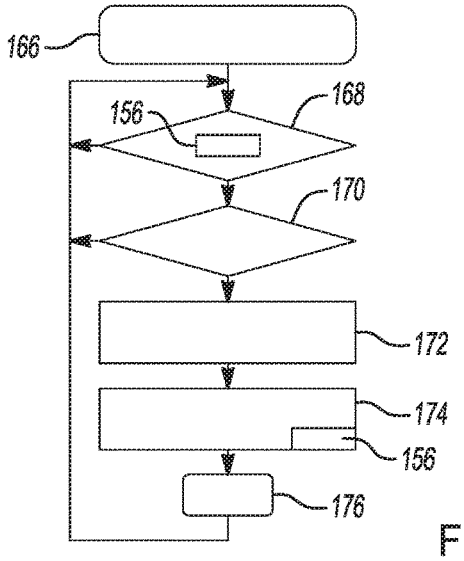
FIG. 7 is a flow chart depicting steps of a purge delivery program determining when a purge pulse should be delivered for each cylinder.

Referring to FIG. 7 and again to FIGS. 1, 2, 5 and 6, a purge delivery program 166 runs to determine when a purge pulse should be delivered for any or for each cylinder. The purge delivery program 166 in a first confirmation step 168 reads the value of the purge counter 156 from the memory 162 of the air accumulation estimation program 150 to identify if the value of the purge request counter is greater than or equal to one (1). If the result from the first confirmation step 168 is yes, in a second confirmation step 170 it is determined from the memory 144 if the purge enabled flag is saved. If the purge enabled flag is present, a purge pulse is enabled and in a control step 172 a synchronized purge pulse such as the purge pulse 106 is issued. In a decrementing step 174 following the control step 172, the purge counter 156 is decremented by one (1) and the program ends at a step 176. If the result of either the first confirmation step 168 or the second confirmation step 170 is no, the purge delivery program 166 returns to the program start.

A variable displacement internal combustion engine control system of the present disclosure offers several advantages. Air trapped in cylinder deactivation hydraulic control passages is more effectively removed, which can otherwise cause increases and higher variation in response times, limiting the operating region or causing mistimed events. The resulting purge on and off angles ranging from approximately 390 to 600 degrees of a running crank angle of the engine is approximately one-third of the switching angle range of known cylinder deactivation systems. The variable displacement internal combustion engine control system of the present disclosure also, provides short purge pulses synchronized to engine position that avoid a cylinder deactivation window, provides for modelling of trapped gas or air based on engine operating conditions (oil temp, oil pressure, engine speed), allows for each cylinder to be modeled and purged independently, provides for purging after engine start, and enables a purge based on current and recent engine conditions.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A variable displacement internal combustion engine control system, comprising:

an engine including multiple cylinders, each cylinder having an intake valve and an exhaust valve;

an engine control circuit configured to: determine when to activate and deactivate one or more cylinders of the multiple cylinders, and determine when to purge gas entrained in an oil system of the engine using a purge pulse;

a solenoid-actuated hydraulic control valve in communication with the engine control circuit, the solenoid-actuated hydraulic control valve operated to deactivate and activate the one or more cylinders; and the purge pulse is limited to a purge pulse range of approximately 210 degrees of a running crank angle of the engine.

2. The variable displacement internal combustion engine control system of claim 1, wherein upon engine startup, the engine control circuit enables the solenoid-actuated hydraulic control valve to initiate individual purge pulses defining multiple purge cycles, cylinder deactivation being precluded during the multiple purge cycles.

3. The variable displacement internal combustion engine control system of claim 2, further including an exhaust port of the solenoid-actuated hydraulic control valve wherein the gas entrained in the oil system is exhausted through the exhaust port.

4. The variable displacement internal combustion engine control system of claim 1, wherein the purge pulse is initiated at a purge pulse initiation point occurring after initiation of lift of the intake valve.

5. The variable displacement internal combustion engine control system of claim 4, wherein the purge pulse ends at a purge pulse end point when the lift of the intake valve returns to zero.

6. The variable displacement internal combustion engine control system of claim 1, wherein the solenoid-actuated hydraulic control valve includes a locking pin exposed to pressurized oil to disconnect the locking pin thereby deactivating the one or more cylinders.

7. The variable displacement internal combustion engine control system of claim 6, wherein the cylinder deactivation is accomplished by opening the solenoid-actuated hydraulic control valve to feed the pressurized oil through control passages to disconnect the locking pin, and when conditions calling for cylinder activated operation are present, the solenoid-actuated hydraulic control valve is actuated to an exhaust position, causing the locking pin to seat.

8. The variable displacement internal combustion engine control system of claim 1, wherein the solenoid-actuated hydraulic control valve is directly mounted to an engine block of the engine, with control passages for the solenoid-actuated hydraulic control valve being positioned in the engine block.

9. The variable displacement internal combustion engine control system of claim 1, wherein the solenoid-actuated hydraulic control valve includes a control port alternately connected with a supply port and an exhaust port, the supply port connected with an engine main oil supply which also feeds multiple pressure oil supply passages, the exhaust port returning oil to the oil system of the engine.

10. The variable displacement internal combustion engine control system of claim 1, further including:

an engine speed sensor generating a speed signal based on an engine speed;

a mass air flow sensor generating a mass air flow signal based on air flow through the intake manifold; and a throttle position sensor generating a position signal based on a throttle position;

wherein the speed signal, the mass air flow signal and the position signal are forwarded to the engine control circuit.

11. A variable displacement internal combustion engine control system, comprising:

an engine including multiple cylinders, each cylinder having an intake valve and an exhaust valve;

an engine control circuit configured to: determine when to activate and deactivate one or more cylinders of the multiple cylinders, and determine when to purge gas entrained in an oil system of the engine using a purge pulse;

a solenoid-actuated hydraulic control valve in communication with the engine control circuit, the solenoid-actuated hydraulic control valve operated to deactivate and activate the one or more cylinders; and the engine control circuit further configured to: identify an approximate gas volume accumulating in a control port of the solenoid-actuated hydraulic control valve and issue a purge pulse when the approximate gas volume has reached a predetermined threshold valued, the purge pulse limited to a purge pulse range between approximately 390 to 600 degrees of a running crank angle of the engine.

12. The variable displacement internal combustion engine control system of claim 11, wherein the engine control circuit is further configured to provide a set of global conditions that must all be met before the purge pulse is enabled.

13. The variable displacement internal combustion engine control system of claim 12, wherein the global conditions further include:

a first confirmation step that determines when a predetermined engine startup delay period has been completed to allow the engine to stabilize; and a second confirmation step that identifies when an engine speed is within a predetermined range of engine speeds wherein the purge pulse is permitted.

14. The variable displacement internal combustion engine control system of claim 13, wherein the global conditions further include:

a third confirmation step that confirms cylinder deactivation, when active, has stabilized; and a fourth confirmation step that confirms, following an operating period when a predetermined minimum period for oil stabilization to occur has been met.

15. The variable displacement internal combustion engine control system of claim 14, wherein the global conditions further include:

a fifth confirmation step that confirms that an oil system pressure is within predetermined limits to permit the purge pulse; and a sixth confirmation step that confirms that an oil system temperature is within predetermined limits to permit the purge pulse.

16. The variable displacement internal combustion engine control system of claim 11, wherein the engine control circuit is further configured to confirm when the purge pulse is delivered for each cylinder, including:

a first confirmation step that confirms a value of a purge counter from a memory to identify when the value of the purge counter is greater than or equal to one (1); and a second confirmation step that confirms from the memory when a purge request is present, and enabling the purge pulse when the purge request is present.

17. The variable displacement internal combustion engine control system of claim 11, wherein the purge pulse is used during one of intake valve lift, exhaust valve lift, and when valve lifters of both the intake valve and the exhaust valve are on a base circle providing zero lift.

18. A variable displacement internal combustion engine control system, comprising:

an engine including multiple cylinders, each cylinder having an intake valve and an exhaust valve;

an engine control circuit configured to: control operation of the engine including determining when to activate and deactivate one or more cylinders, and determine when to purge gas entrained in an oil system of the engine;

a solenoid-actuated hydraulic control valve in communication with the engine control module, the solenoid-actuated hydraulic control valve operated to deactivate and activate the one or more cylinders;

wherein the engine control circuit is further configured to provide a set of global conditions that must all be met before a purge pulse is enabled; and the purge pulse is initiated by the engine control circuit at a purge pulse initiation point occurring after the purge pulse is enabled and during one of intake valve lift, exhaust valve lift, and when valve lifters of both the intake and the exhaust valve are on a base circle providing zero lift, the purge pulse is limited to a purge pulse range between approximately 390 to 600 degrees of a running crank angle of the engine.

19. The variable displacement internal combustion engine control system of claim 18, wherein the engine control circuit is further configured: to run an air accumulation estimation multiple times per second for each cylinder; to identify an approximate gas volume accumulating in a control port of the solenoid-actuated hydraulic control valve; and to issue a purge pulse when the approximate gas volume has reached a predetermined threshold value.

* * * * *